US009725820B2

(12) United States Patent
Kobayashi

(10) Patent No.: US 9,725,820 B2
(45) Date of Patent: Aug. 8, 2017

(54) PARTIAL SURFACE TREATMENT APPARATUS

(71) Applicant: Aisin Seiki Kabushiki Kaisha, Kariya-shi (JP)

(72) Inventor: Daishi Kobayashi, Kariya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 239 days.

(21) Appl. No.: 14/489,729

(22) Filed: Sep. 18, 2014

(65) Prior Publication Data

US 2015/0083583 A1 Mar. 26, 2015

(30) Foreign Application Priority Data

Sep. 20, 2013 (JP) ..... 2013-195805

(51) Int. Cl.
*C25F 7/00* (2006.01)
*C25D 17/00* (2006.01)
*C25D 11/02* (2006.01)

(52) U.S. Cl.
CPC ..... *C25F 7/00* (2013.01); *C25D 11/022* (2013.01); *C25D 17/00* (2013.01); *C25D 17/004* (2013.01)

(58) Field of Classification Search
CPC ..... C25D 17/002; C25D 17/004
See application file for complete search history.

(56) References Cited

U.S. PATENT DOCUMENTS

2011/0233053 A1* 9/2011 Kobayashi ..... C25D 5/02 204/275.1
2012/0146293 A1* 6/2012 Reeb ..... F16J 15/3236 277/589

FOREIGN PATENT DOCUMENTS

JP 2011-219858 11/2011

OTHER PUBLICATIONS

Parker—Press-in-Place Seal Product documentation Nov. 2012.*

* cited by examiner

*Primary Examiner* — Louis Rufo
(74) *Attorney, Agent, or Firm* — Oblon, McClelland, Maier & Neustadt, L.L.P.

(57) ABSTRACT

A partial surface treatment apparatus includes a first electrode member electrically connected to a treatment object including an outer circumferential surface and a circumferential groove, a second electrode member including an inner circumferential surface, a pair of annular-shaped elastic sealing members configured to seal a clearance between the outer circumferential surface and the inner circumferential surface, an accommodation portion accommodating each of the annular-shaped elastic sealing members, the annular-shaped elastic sealing members are movable in a diameter reduction direction, a pressure applying mechanism supplying a pressurized fluid to the annular-shaped elastic sealing members, the annular-shaped elastic sealing members are in pressure contact with the outer circumferential surface in a case where the annular-shaped elastic sealing members are moved in the diameter reduction direction, and a cutout formed at each of the annular-shaped elastic sealing members to be extended from an outer circumferential side edge portion towards the inner circumferential side.

11 Claims, 9 Drawing Sheets

PARTIAL SURFACE TREATMENT APPARATUS

CROSS REFERENCE TO RELATED APPLICATIONS

This application is based on and claims priority under 35 U.S.C. §119 to Japanese Patent Application 2013-195805, filed on Sep. 20, 2013, the entire content of which is incorporated herein by reference.

TECHNICAL FIELD

This disclosure generally relates to a partial surface treatment apparatus.

BACKGROUND DISCUSSION

A known partial surface treatment apparatus is disclosed in JP2011-219858A (which will be hereinafter referred to as Patent reference 1). The known partial surface treatment apparatus includes a first electrode member electrically connected to a treatment object which is made of metal and which includes an outer circumferential surface and a circumferential groove formed at the outer circumferential surface. The known partial surface treatment apparatus includes a second electrode member including an inner circumferential surface facing the outer circumferential surface and the circumferential groove, the inner circumferential surface being spaced apart from the outer circumferential surface and the circumferential groove along an entire circumference of the inner circumferential surface. The known partial surface treatment apparatus includes a pair of annular-shaped elastic sealing members each of which is nonconductive, the annular-shaped elastic sealing members being configured to seal, at both sides relative to the circumferential groove, a clearance formed between the outer circumferential surface and the inner circumferential surface. The known partial surface treatment apparatus includes a circumferential groove portion accommodating each of the annular-shaped elastic sealing members in such a manner that the annular-shaped elastic sealing member is spaced apart from the outer circumferential surface and that the annular-shaped elastic sealing member is movable in a diameter reduction direction. The known partial surface treatment apparatus includes a pressure applying mechanism configured to supply a pressurized fluid to an outer circumferential side of the annular-shaped elastic sealing members fitted into the circumferential groove portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact. The known partial surface treatment apparatus includes a supply flow passage through which electrolyte solution is supplied to a space formed between the outer circumferential surface and the inner circumferential surface, the space being sealed with the pair of annular-shaped elastic sealing members. The annular-shaped elastic sealing member of the known partial surface treatment apparatus is formed in a shape including a pair of annular-shaped side wall portions and an annular-shaped end portion. The pair of annular-shaped side wall portions are configured to be in slidably contact with groove side surfaces, which face each other, of the circumferential groove portion while the pair of annular-shaped side wall portions are apart from each other in a groove width direction. The annular-shaped end portion connects inner circumferential portions of the respective annular-shaped side wall portions to each other serially. The annular-shaped elastic sealing member of the known partial surface treatment apparatus is formed in an annular shape where the same cross-sectional shape continues along the entire circumference thereof. An inner circumferential side of the annular-shaped end portion is in pressure contact with the outer circumferential surface of the treatment object.

According to the known partial surface treatment apparatus disclosed in Patent reference 1, at the both sides relative to the circumferential groove, the annular-shaped elastic sealing members seal the clearance between the outer circumferential surface of the treatment object and the inner circumferential surface of the second electrode member. Then, the electrolyte solution is supplied to a space which is formed between the outer circumferential surface and the inner circumferential surface and is sealed with the annular-shaped elastic sealing members, and thus a surface treatment is conducted relative to the circumferential groove.

In order to seal the clearance between the outer circumferential surface and the inner circumferential surface, the pressure applying mechanism supplies pressurized fluid such as compressed air to a portion between the pair of annular-shaped side wall portions of the annular-shaped elastic sealing member fitted into the circumferential groove portion, and accordingly the annular-shaped elastic sealing member is moved in the diameter reduction direction in which the inner circumferential side of the annular-shaped end portion is in pressure contact with the outer circumferential surface. Accordingly, a circumferential length, at the inner circumferential side, of the annular-shaped end portion before sealing the clearance is longer compared to a circumferential length, at an outer circumferential side, of the treatment object with which the inner circumferential side of the annular-shaped end portion is to be in pressure contact.

According to the annular-shaped elastic sealing member provided at the known partial surface treatment apparatus, the inner circumferential sides of the pair of annular-shaped side wall portions are connected to each other at the annular-shaped end portion. The annular-shaped elastic sealing member of the known partial surface treatment apparatus is formed in the annular shape which continues in the same cross-sectional configuration along the entire circumference. As a result, in association with an elastic deformation of the annular-shaped elastic sealing member in the diameter reduction direction, wrinkle tends to be formed at the annular-shaped elastic sealing member due to a compressing force generated at the annular-shaped elastic sealing member in a circumferential direction thereof.

In a case where a large wrinkle is generated at the annular-shaped elastic sealing member sealing the clearance, the electrolyte solution supplied to the space which is formed between the outer circumferential surface and the inner circumferential surface and which is sealed with the pair of annular-shaped elastic sealing members may leak out from the wrinkled portion.

In order to avoid such a leakage at the wrinkled portion, it can be conceived that a moving speed of the annular-shaped elastic sealing member in the diameter reduction direction is reduced so that small wrinkles are generated in a spread-out manner in the circumferential direction of the annular-shaped elastic sealing member, for example. However, in a case where the annular-shaped elastic sealing member is elastically deformed over a long period of time, the surface treatment may not be performed efficiently.

In addition, in a case where the electrolyte solution leaks out towards the outer circumferential side of the annular-shaped elastic sealing member via the wrinkled portion, the leaking electrolyte solution is mixed with the pressurized fluid supplied to the outer circumferential side of the annular-shaped elastic sealing member. As a result, inconvenience tends to occur, for example, the pressure applying mechanism and/or an electrolyte solution distribution mechanism may be damaged.

A need thus exists for a partial surface treatment apparatus which is not susceptible to the drawback mentioned above.

SUMMARY

According to an aspect of this disclosure, a partial surface treatment apparatus includes a first electrode member electrically connected to a treatment object made of metal, the treatment object including an outer circumferential surface and a circumferential groove formed at the outer circumferential surface, a second electrode member including an inner circumferential surface facing the outer circumferential surface and the circumferential groove, the inner circumferential surface being spaced apart from the outer circumferential surface and the circumferential groove along an entire circumference of the inner circumferential surface, a pair of annular-shaped elastic sealing members each of which is nonconductive, the annular-shaped elastic sealing members being configured to seal, at both sides relative to the circumferential groove, a clearance formed between the outer circumferential surface and the inner circumferential surface, an accommodation portion accommodating each of the annular-shaped elastic sealing members in such a manner that the annular-shaped elastic sealing member is spaced apart from the outer circumferential surface and that the annular-shaped elastic sealing member is movable in a diameter reduction direction, the accommodation portion including groove side surfaces arranged to face each other, a pressure applying mechanism configured to supply a pressurized fluid to an outer circumferential side of the annular-shaped elastic sealing members fitted into the accommodation portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact between the annular-shaped elastic sealing members and the outer circumferential surface, a supply flow passage through which electrolyte solution is supplied to a space formed between the outer circumferential surface and the inner circumferential surface, the space being sealed with the pair of annular-shaped elastic sealing members, each of the annular-shaped elastic sealing members being formed in a shape including a pair of annular-shaped side wall portions and an annular-shaped end portion, the pair of annular-shaped side wall portions being configured to be in slidably contact with the corresponding groove side surfaces of the accommodation portion while the pair of annular-shaped side wall portions being apart from each other in a groove width direction, the annular-shaped end portion connecting inner circumferential portions of the respective annular-shaped side wall portions to each other serially, and a cutout being formed at each of the annular-shaped elastic sealing members to be extended from an outer circumferential side edge portion of the annular-shaped elastic sealing member towards the inner circumferential side of the annular-shaped elastic sealing member, the cutout being provided at at least one position which is along a circumferential direction of the annular-shaped elastic sealing member.

According to another aspect of this disclosure, a partial surface treatment apparatus includes a first electrode member electrically connected to a treatment object made of metal, the treatment object including an outer circumferential surface and a circumferential groove formed at the outer circumferential surface, a second electrode member including an inner circumferential surface facing the outer circumferential surface and the circumferential groove, the inner circumferential surface being spaced apart from the outer circumferential surface and the circumferential groove along an entire circumference of the inner circumferential surface, a pair of annular-shaped elastic sealing members each of which is nonconductive, the annular-shaped elastic sealing members being configured to seal, at both sides relative to the circumferential groove, a clearance formed between the outer circumferential surface and the inner circumferential surface, an accommodation portion accommodating each of the annular-shaped elastic sealing members in such a manner that the annular-shaped elastic sealing member is spaced apart from the outer circumferential surface and that the annular-shaped elastic sealing member is movable in a diameter reduction direction, the accommodation portion including groove side surfaces arranged to face each other, a pressure applying mechanism configured to supply a pressurized fluid to an outer circumferential side of the annular-shaped elastic sealing members fitted into the accommodation portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact between the annular-shaped elastic sealing members and the outer circumferential surface, a supply flow passage through which electrolyte solution is supplied to a space formed between the outer circumferential surface and the inner circumferential surface, the space being sealed with the pair of annular-shaped elastic sealing members, each of the annular-shaped elastic sealing members including a pair of annular-shaped side wall portions, an annular-shaped end portion and a plurality of cutouts, the pair of annular-shaped side wall portions being configured to be in slidably contact with the corresponding groove side surfaces of the accommodation portion, the pair of annular-shaped side wall portions being apart from each other in a groove width direction, the annular-shaped end portion connecting inner circumferential portions of the respective annular-shaped side wall portions to each other serially, the plurality of cutouts being formed along a circumferential direction of the annular-shaped elastic sealing member while a uniform space is provided therebetween, each of the cutouts being extended from an outer circumferential edge of the annular-shaped elastic sealing member towards a radially inner side of the annular-shaped elastic sealing member.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A first embodiment disclosed here will be described hereunder with reference to the drawings. In this embodiment, an anodizing treatment apparatus which conducts an anodizing treatment (a surface treatment) to a surface of a piston A made of an aluminum alloy which serves as a treatment object made of metal is described as an example of a partial surface treatment apparatus of this embodiment. Illustrated in each of FIGS. 1 to 10 is the anodizing treatment apparatus, which executes the anodizing treatment to a piston ring groove A1 of the piston A. Additionally, "the piston ring groove A1 of the piston A", "the anodizing treatment" and "the anodizing treatment apparatus" are examples, therefore the partial surface treatment apparatus is adaptable to other surface treatments.

More specifically, the anodizing treatment is applied to an outer circumferential surface B (which will be hereinafter referred to as a piston outer circumferential surface) including the piston ring groove A1 (i.e. a compression ring groove) positioned closer to a top portion of the piston A out of three piston ring grooves A1, A2 and A3. The piston ring grooves A1, A2 and A3 are formed on the piston A in such a manner that the piston ring groove A1 is positioned closer to the top portion of the piston A, the piston ring groove A3 is positioned at a skirt portion of the piston A and the piston ring groove A2 is positioned between the piston ring grooves A1 and A3. The piston ring groove A1 corresponds to a circumferential groove formed on the piston outer circumferential surface B.

Figure 1:
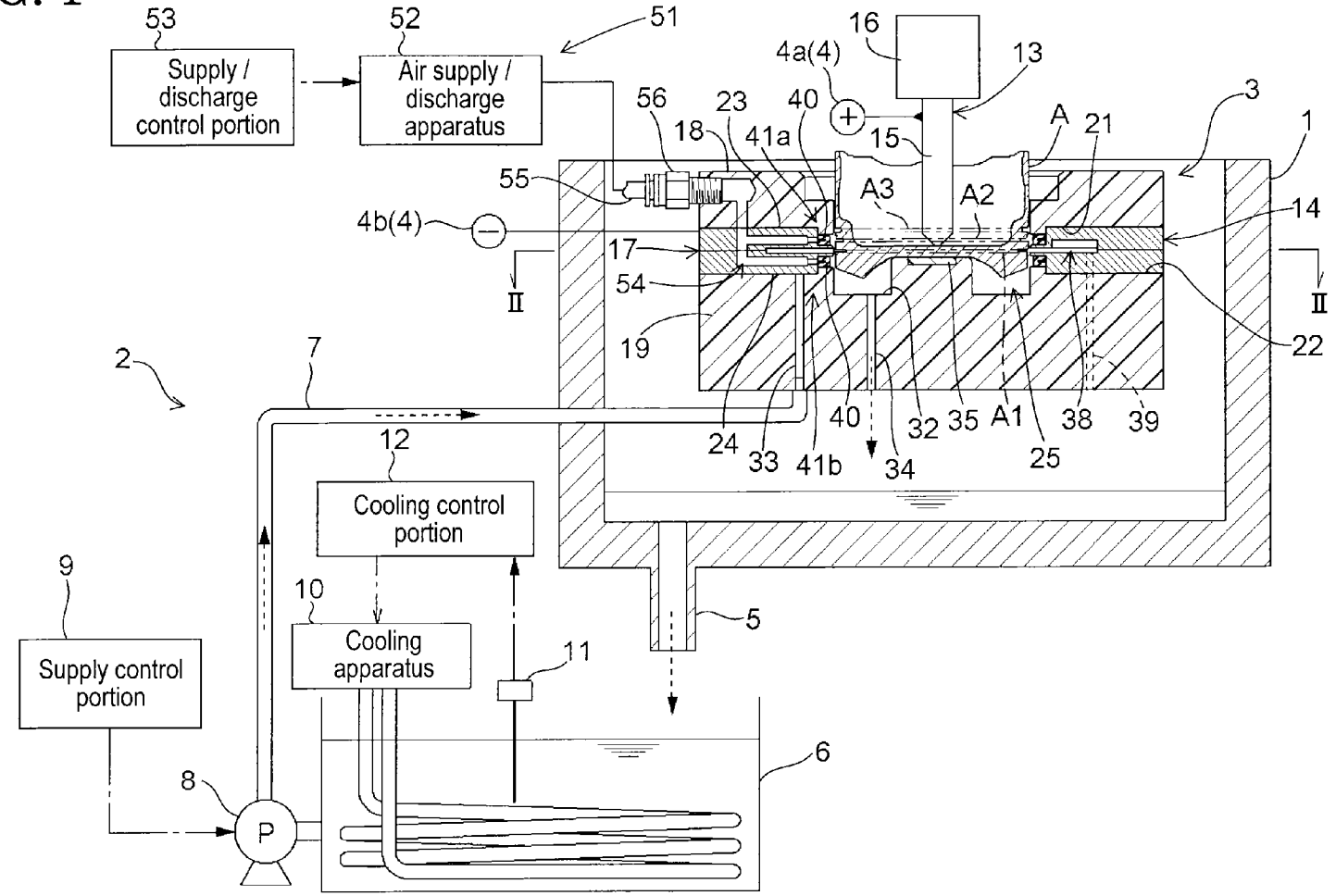
FIG. 1 is a schematic view of a partial surface treatment apparatus (an anodizing treatment apparatus) according to first and second embodiments disclosed here.
Figure 2:
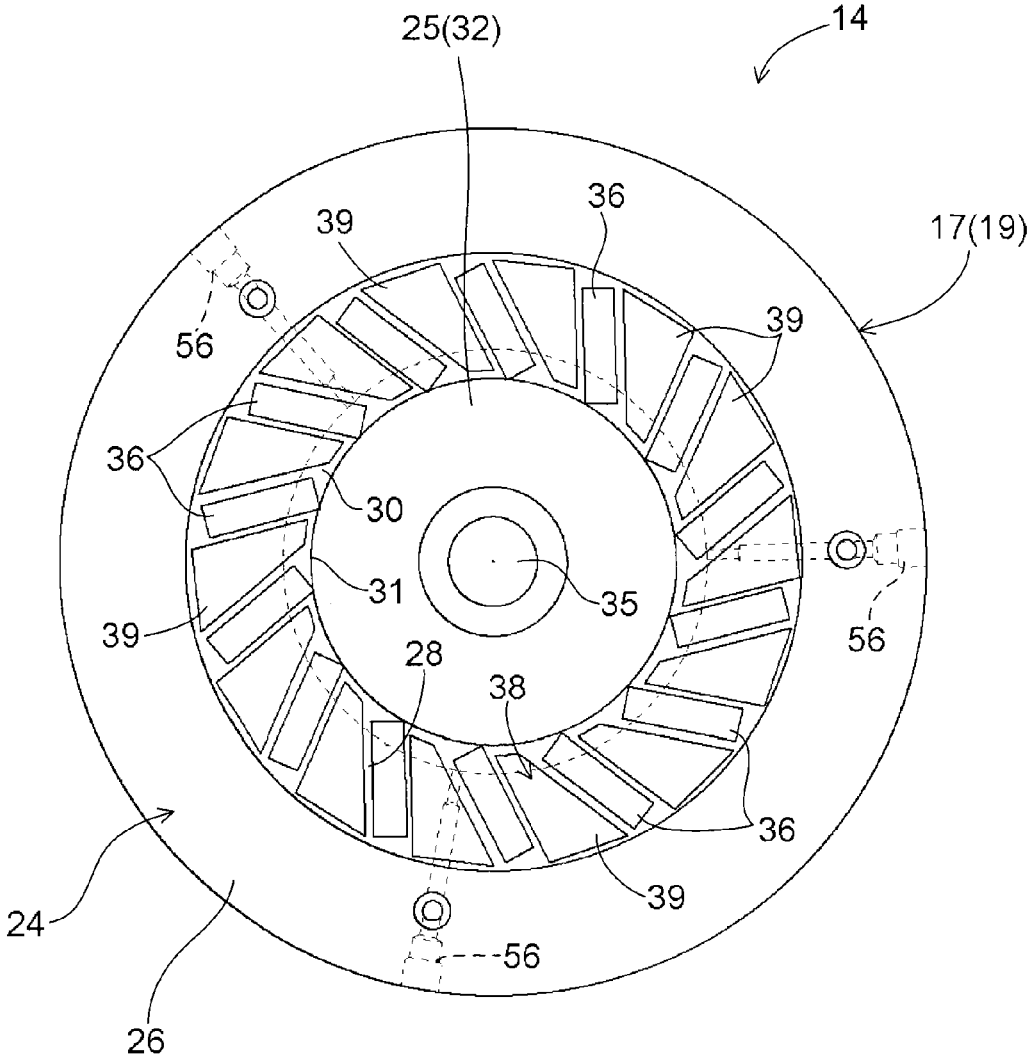
FIG. 2 is a plan view of a second electrode portion which is seen from a direction of the arrow of line II-II in FIG. 1.

The anodizing treatment apparatus includes an electrolyte solution tank 1, an electrolyte solution supplying portion 2, an oxidation treatment portion 3 and an electrifying portion 4. As illustrated in FIGS. 1 and 2, the electrolyte solution tank 1, which is made of a polyvinyl chloride or SUS316, is formed in a container having an opening portion at an upper end portion thereof. The electrolyte solution tank 1 receives electrolyte solution, which flows through the oxidation treatment portion 3 in order to collect the electrolyte solution. Furthermore, the electrolyte solution tank 1 includes a reflux passage 5 for flowing back the electrolyte solution to the electrolyte solution supplying portion 2.

The electrolyte solution supplying portion 2 includes a cooling tank 6 for cooling down the electrolyte solution which is flown back thereto from the electrolyte solution tank 1, a supply passage 7 through which the electrolyte solution in the cooling tank 6 is supplied to the oxidation treatment portion 3, a supply pump 8 provided at the supply passage 7, and a supply control portion 9 which controls an actuation of the supply pump 8 in order to supply the electrolyte solution to the oxidation treatment portion 3 at a predetermined timing.

The cooling tank 6 includes a cooling apparatus 10 which cools down the collected electrolyte solution, and a cooling control portion 12 which controls an actuation of the cooling apparatus 10 on the basis of a detection information of the electrolyte solution temperature obtained by a temperature sensor 11 so that the electrolyte solution is cooled down to a predetermined temperature.

The electrifying portion 4 electrifies the oxidation treatment portion 3. The electrifying portion 4 may be configured so as to include a current control device, so that the electrifying portion 4 can adjust a current density. A known current control device constituted by an ampere meter, a voltage indicator, a rectifier and the like may be used as the current control device.

The oxidation treatment portion 3 includes a first electrode portion 13 (anode) and a second electrode portion 14 (cathode). The first electrode portion 13 includes a first electrode member 15 which is made of metal having electric conductivity such as copper or SUS316, and a lifting device 16 which is configured so as to lift up and lower the first electrode member 15 relative to the second electrode portion 14. The first electrode member 15 also serves as a retaining member for supporting and retaining the piston A. Furthermore, the first electrode member 15 is electrically connected to an anode terminal 4*a* of the electrifying portion 4.

The retaining member 15 (i.e. the first electrode member 15) includes an engagement pawl at a lower end portion thereof so that the retaining member 15 is engageable with and disengageable from an inner circumferential surface of the piston A. The engagement pawl engages with the inner circumferential surface of the piston A, and accordingly the retaining member 15 retains the piston A in a state where an axis of the piston A extends in a vertical direction and the piston A is being electrically connected to the retaining member 15.

As illustrated in FIG. 2, the second electrode portion 14 is formed in such a manner that an outer shape thereof forms a round shape in a plane view. Furthermore, the second electrode portion 14 includes a piston insertion bore 25 which extends in a concentric manner and which is formed in a round shape in a plane view. Accordingly, the piston A is inserted into the piston insertion bore 25 so that the axis the piston A extends in an up/down direction along the piston insertion bore 25.

As illustrated in FIG. 1, the second electrode portion 14 includes a second electrode member 17, a first fixing plate 18 and a second fixing plate 19. The second electrode member 17 is made of metal having the electric conductivity such as the copper or SUS316. On the other hand, each of the first and second fixing plates 18 and 19 is made of a nonconductive material (insulator) such as a polyvinyl chloride resin and the like. Furthermore, the first and second fixing plates 18 and 19 are arranged so as to sandwich the second electrode member 17, more specifically, the first fixing plate 18 is arranged at an upper portion of the second electrode member 17 and the second fixing plate 19 is arranged at a lower portion of the second electrode member 17. The first fixing plate 18 and the second fixing plate 19 are connected to each other by means of a bolt (bolts).

The second electrode member 17 is provided between an upwardly-recessed surface portion 21 and a downwardly-recessed surface portion 22 so as to be fitted into a space formed therebetween. Furthermore, the second electrode member 17 is connected to each of the upwardly-recessed surface portion 21 and the downwardly-recessed surface portion 22 by means of a bolt (bolts). The upwardly-recessed surface portion 21 is formed at an outer circumferential lower surface of the first fixing plate 18, which is arranged at the upper side, so as to recess upwardly in an annular shape. On the other hand, the downwardly-recessed surface portion 22 is formed at an outer circumferential upper surface of the second fixing plate 19, which is arranged at the lower side, so as to recess downwardly in an annular shape.

As illustrated in FIG. 1, the second electrode member 17 is constituted by a first electrode plate 23 and a second electrode plate 24. The two electrode plates, that is, the first and second electrode plates 23 and 24 are connected to each other by means of a bolt (bolts) in a state where the first electrode plate 23 is arranged upon the second electrode plate 24. The second electrode member 17 is electrically connected to a cathode terminal 4*b* of the electrifying portion 4.

As illustrated in FIGS. 3 to 6, the first electrode plate 23 includes an outer circumferential portion 26 which is positioned close to the outer circumference of the first electrode plate 23 and a first thin plate portion 27 which is positioned at a side close to the piston insertion bore 25. The first thin plate portion 27 is formed to be thinner than the outer circumferential portion 26. Similarly, the second electrode plate 24 includes an outer circumferential portion 26 which is positioned close to the outer circumference of the first electrode plate 23 and a second thin plate portion 28 which is positioned at the side close to the piston insertion bore 25. The second thin plate portion 28 is formed to be thinner than the outer circumferential portion 26. Further, the first electrode plate 23 includes a first flange plate portion 29 which is formed in an annular shape so as to extend towards the piston insertion bore 25 along an inner circumferential portion of the first thin plate portions 27, and the second electrode plate 24 includes a second flange plate portion 30 which is formed in an annular shape so as to extend towards the piston insertion bore 25 along an inner circumferential portion of the second thin plate portions 28. A space at a radially inner side of an inner circumferential surface (which will be hereinafter referred to as an electrode inner circumferential surface) 31 of each of the first and second flange plate portions 29 and 30 is formed to serve as the piston insertion bore 25. Therefore, the electrode inner circumferential surface 31 of each of the first and second flange plate portions 29 and 30 is formed as an annular-shaped inner circumferential surface that faces the piston outer circumferential surface B and the piston ring groove A1 while being spaced apart from the piston outer circumferential surface B and the piston ring groove A1 by a constant distance along the entire circumference.

As illustrated in FIG. 1, the second fixing plate 19 includes a round-shaped recessed surface portion 32 and a round-shaped protruding surface portion 35. The round-shaped recessed surface portion 32 is formed in such a manner that a diameter thereof corresponds to the piston insertion bore 25 and that the round-shaped recessed surface portion 32 is concentric with the piston insertion bore 25. On the other hand, the round-shaped protruding surface portion 35 supports a top surface of the piston A which is placed on the round-shaped protruding surface portion 35 in a state where the axis of the piston A extends in the up/down direction. The second fixing plate 19 includes a connecting fluid passage 33 which is connected to the supply passage 7 of the electrolyte solution, and a discharge hole 34 through which the electrolyte solution accumulated within the round-shaped recessed surface portion 32 is naturally discharged (due to the gravity flow) to the electrolyte solution tank 1.

Accordingly, as illustrated in FIG. 1, the piston A, which is retained by the retaining member 15 (the first electrode member 15) in the state where the piston A is electrically connected to the first electrode member 15 while the axis of the piston A extends in the vertical direction, is inserted into the piston insertion bore 25 and the top surface of the piston A is placed on the round-shaped protruding surface portion 35. Accordingly, as illustrated in FIG. 3, the piston A is arranged at a position in such a manner that the piston outer circumferential surface B is being away from the electrode inner circumferential surfaces 31 so as to form a clearance C, which is a constant clearance, between the piston outer circumferential surface B and the electrode inner circumferential surfaces 31 along the entire circumference thereof in a concentric manner.

Figure 3:
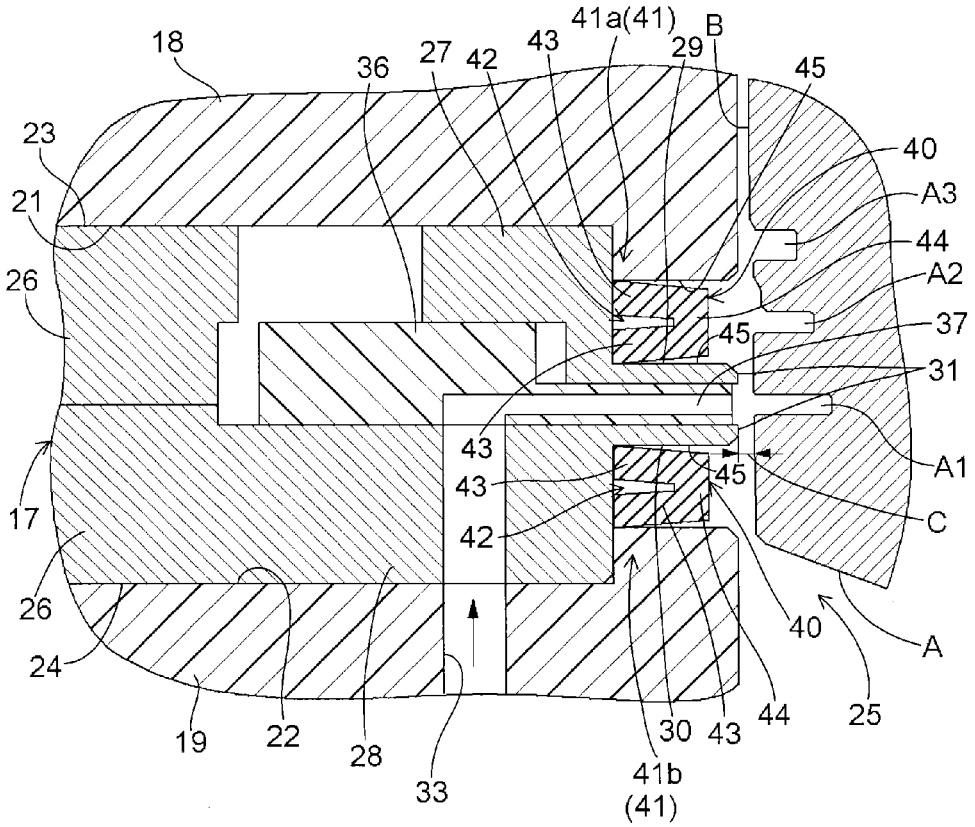
FIG. 3 is a cross-sectional view illustrating an electrolyte solution supply nozzle portion of a second electrode member according to the embodiments.
Figure 4:
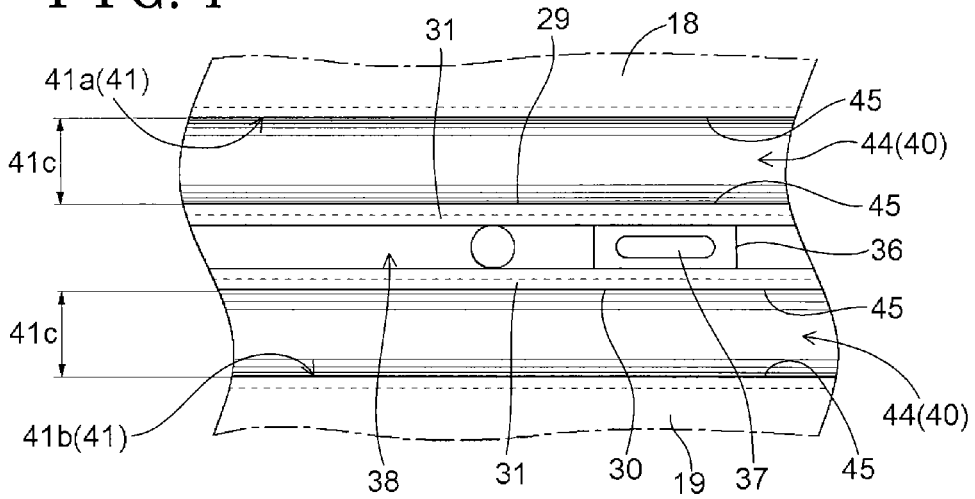
FIG. 4 is a side view illustrating an inner circumferential side of the electrolyte solution supply nozzle portion of the second electrode member.

As illustrated in FIGS. 2 to 4, plural electrolyte solution supply nozzles 36 are arranged between the first thin plate portion 27 and the first flange portion 29 of the first electrode plate 23 on the one hand and the second thin plate portion 28 and the second flange portion 30 of the second electrode plate 24 on the other hand. The plural electrolyte solution supply nozzles 36 are arranged in a circumferential direction while keeping a predetermined distance between the neighboring electrolyte solution supply nozzles 36 in the circumferential direction. Each of the electrolyte solution supply nozzles 36 is arranged in such a manner that the electrolyte solution is supplied between the piston outer circumferential surface B and the electrode inner circumferential surfaces 31 in a direction that is inclined relative to a tangential line of the electrode inner circumferential surfaces 31.

As illustrated in FIGS. 3 and 4, each of the electrolyte solution supply nozzles 36 is connected to the connecting fluid passage 33. Furthermore, each of the electrolyte solution supply nozzles 36 includes a supply flow passage 37 through which the electrolyte solution is supplied to a space formed between the piston outer circumferential surface B and the electrode inner circumferential surfaces 31. As will be described later, the space between the piston outer circumferential surface B and the electrode inner circumferential surfaces 31 is sealed with a pair of annular-shaped elastic sealing members 40 each including a circular form.

The supply flow passage 37 of each of the electrolyte solution supply nozzles 36 opens at the electrode inner circumferential surfaces 31.

As illustrated in FIGS. 1 to 4, between the neighboring electrolyte solution supply nozzles 36 in the circumferential direction, a space between the first thin plate portion 27 and the second thin plate portion 28, and a space between the first flange portion 29 and the second flange portion 30 are provided so as to serve as a discharge flow passage 38 of the electrolyte solution.

As illustrated in FIG. 2, a through hole 39 extending through the second thin plate portion 28 and the second fixing plate 19 is formed between the neighboring electrolyte solution supply nozzles 36 in the circumferential direction. The electrolyte solution within the discharge flow passage 38 is naturally discharged towards the electrolyte solution tank 1 through the through holes 39 by gravity.

As illustrated in FIGS. 1 and 3 to 6, the pair of annular-shaped elastic sealing members 40 and a pair of accommodation portions 41 are provided at the second electrode member 17, at a side where the electrode inner circumferential surface 31 is positioned. The pair of annular-shaped elastic sealing members 40, each of which is a nonconductive sealing member, are arranged at an upper side and a lower side, respectively. Each of the accommodation portions 41 accommodates the corresponding annular-shaped elastic sealing member 40 in such a manner that the annular-shaped elastic sealing member 40 is spaced apart from the piston outer circumferential surface B by a distance along the entire circumference thereof, and that the corresponding annular-shaped elastic sealing member 40 is movable in a diameter reduction direction, that is, in a direction in which a diameter of the annular-shaped elastic sealing member 40 decreases.

The accommodation portions 41 include a first accommodation portion 41*a* into which the annular-shaped elastic sealing member 40 arranged at the upper side is fitted and a second accommodation portion 41*b* into which the annular-shaped elastic sealing member 40 arranged at the lower side is fitted. The first accommodation portion 41*a* is formed between a groove side surface 45 constituted by an upper surface of the first flange plate portion 29 of the first electrode plate 23 and a groove side surface 45 constituted by a bottom surface of the first fixing plate 18, and the groove side surfaces 45 which constitute the first accommodation portion 41*a* face each other to be parallel to each other. The second accommodation portion 41*b* is formed between a groove side surface 45 constituted by a lower surface of the second flange plate portion 30 of the second electrode plate 24 and a groove side surface 45 constituted by an upper surface of the second fixing plate 19, and the groove side surfaces 45 which constitute the second accommodation portion 41*b* face each other to be parallel to each other.

Figure 7:
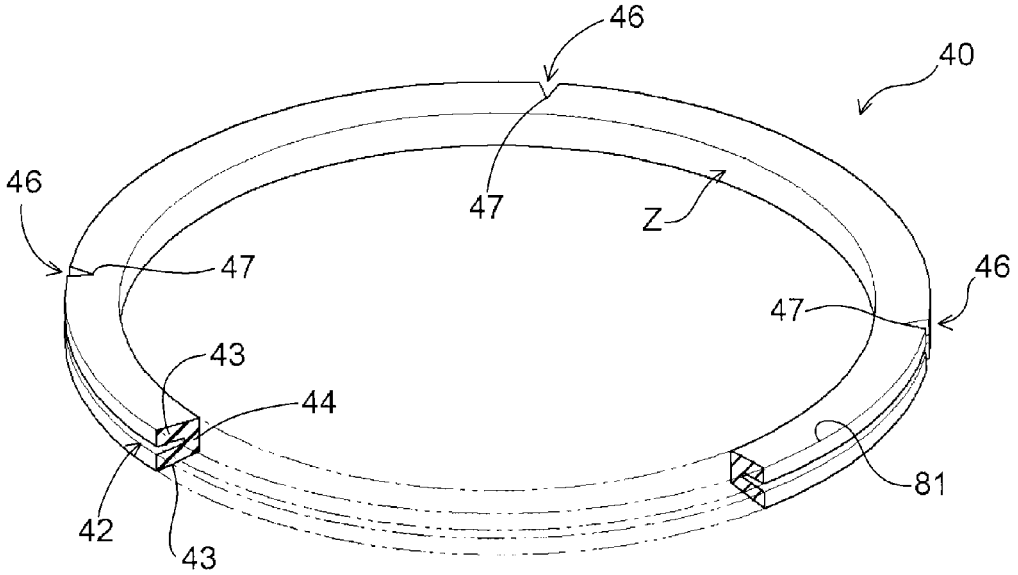
FIG. 7 is a perspective view of the annular-shaped elastic sealing member.
Figure 8:
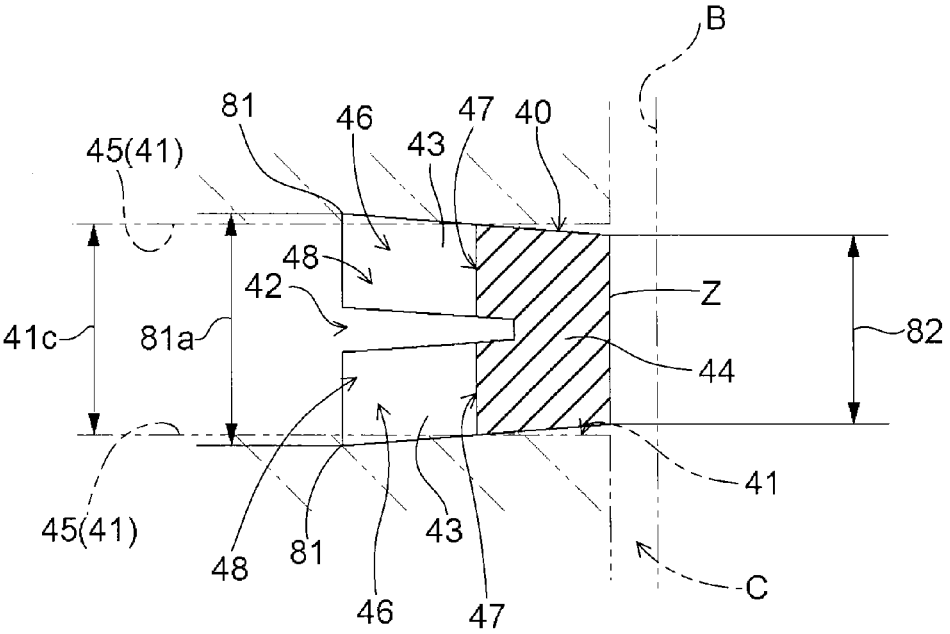
FIG. 8 is an enlarged cross-sectional view of the annular-shaped elastic sealing member.

Illustrated in each of FIGS. 7 and 8 is the annular-shaped elastic sealing member 40 before being fitted into the accommodation portion 41. As illustrated in FIG. 7, each of the annular-shaped elastic sealing members 40 is made of a nonconductive material (an insulator) such as rubber and the like and is formed in the annular shape or a ring shape. Each of the annular-shaped elastic sealing members 40 includes a recessed portion 42 which opens toward an outer circumferential side of the annular-shaped elastic sealing member 40 and is formed serially or continuously along the entire circumference thereof. The annular-shaped elastic sealing members 40 are configured to seal the clearance C formed between the piston outer circumferential surface B and the electrode inner circumferential surfaces 31, at both sides relative to the piston ring groove A1, that is, at the upper side and the lower side relative to the piston ring groove A1, respectively.

Each of the annular-shaped elastic sealing members 40 integrally includes a pair of annular-shaped side wall portions 43, 43 and an annular-shaped end portion 44. The pair of annular-shaped side wall portions 43 are configured to be in slidably contact with the corresponding groove side surfaces 45 of the accommodation portions 41*a*, 41*b* while the pair of annular-shaped side wall portions 43 are apart from each other by a distance in a groove width direction. The annular-shaped end portion 44 connects inner circumferential portions of the pair of annular-shaped side wall portions 43 to each other serially or continuously. Accordingly, each of the annular-shaped elastic sealing members 40 includes a transverse cross section which is formed substantially in a shape of a letter U that is in a horizontal position. A space defined between the pair of annular-shaped side wall portions 43 defines the recessed portion 42.

The annular-shaped elastic sealing members 40 are fitted into the respective first and second accommodation portions 41*a* and 41*b* in a manner that each of the annular-shaped end portions 44 does not protrude towards the piston outer circumferential surface B relative to the electrode inner circumferential surface 31. By bringing the annular-shaped end portions 44 into pressure contact with the piston outer circumferential surface B, the clearance C between the piston outer circumferential surface B and the electrode inner circumferential surfaces 31 is sealed.

As illustrated in FIG. 8, a pressure contact surface Z of each of the annular-shaped end portions 44, which is configured to be in pressure contact with the piston outer circumferential surface B, is formed by a surface that is parallel to an axial direction of the annular-shaped elastic sealing members 40. Thus, the pressure contact surface Z is a surface formed in a cylindrical shape that faces the piston outer circumferential surface B to be parallel thereto. The axial direction of the annular-shaped elastic sealing members 40 is a direction which extends through the annular shape at the center thereof.

As illustrated in FIG. 8, in a state where each of the annular-shaped elastic sealing members 40 is not fitted in the corresponding accommodation portion 41, a thickness of an outer circumferential portion of the annular-shaped elastic sealing member 40, that is, an axial length 81*a* at outer circumferential side edge portions 81 of the respective annular-shaped side wall portions 43, is set to be longer than an opening width 41*c* of the accommodation portion 41. In addition, in the state where each of the annular-shaped elastic sealing members 40 is not fitted in the corresponding accommodation portion 41, a thickness of an inner circumferential portion of the annular-shaped elastic sealing member 40, that is, an axial length 82 of the pressure contact surface Z, is set to be shorter than the opening width 41*c* of the accommodation portion 41.

Accordingly, each of the annular-shaped elastic sealing members 40 is fitted into the corresponding accommodation portion 41 in a state where the pair of annular-shaped side wall portions 43 are elastically deformed in directions in which the pair of annular-shaped side wall portions 43 come closer to each other. The annular-shaped side wall portions 43 are pressed against the respective groove side surfaces 45 by an elastic restoring force of the pair of annular-shaped side wall portions 43 that tend to deform in directions in which the annular-shaped side wall portions 43 are away from each other to return to their original shapes.

Figure 9:
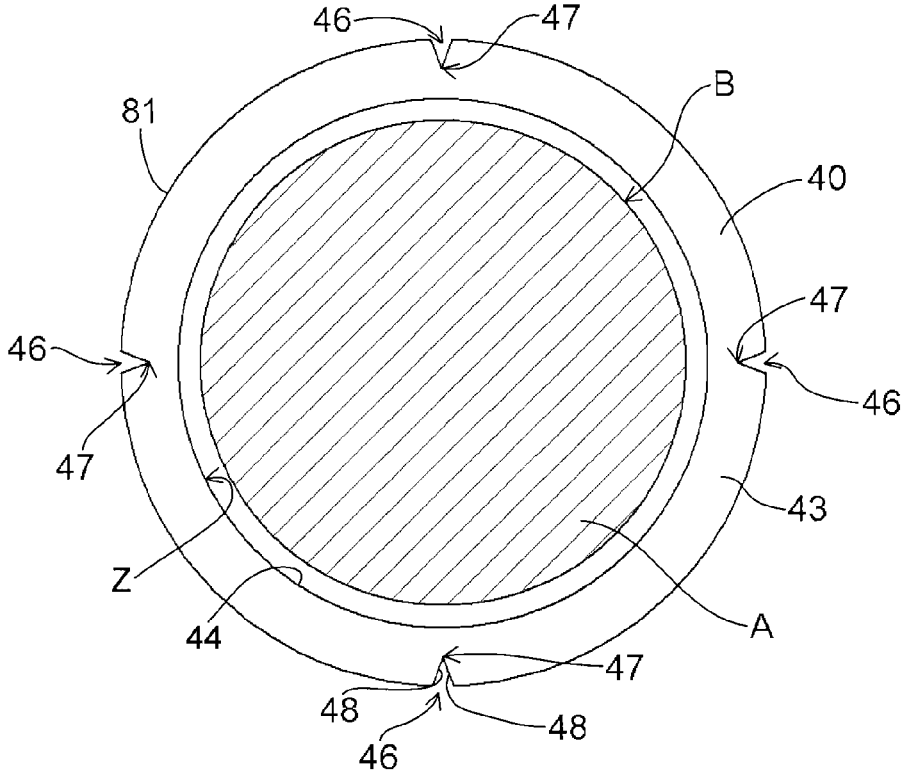
FIG. 9 is a plan view illustrating the annular-shaped elastic sealing member which is separated from the piston outer circumferential surface.

A cutout 46 is provided at at least one position of each of the annular-shaped elastic sealing members 40 in a circumferential direction. The cutout 46 is formed to be extended from the outer circumferential side edge portion 81 towards the inner circumferential side of the annular-shaped elastic sealing member 40, that is, towards a radially inner side of the annular-shaped elastic sealing member 40. For example, as illustrated in FIG. 9, the cutout 46 includes a start portion and an end portion 47. The cutout 46 is formed in a manner that the start portion thereof corresponds to the outer circumferential side edge portions 81 and that the end portion 47 thereof is provided within a region of the annular-shaped side wall portion 43, that is, the region in which the annular-shaped side wall portion 43 is formed. For example, the cutout 46 is provided at four positions of each of the pair of annular-shaped side wall portions 43 so as to be arranged in the circumferential direction with a uniform space provided between each of the neighboring cutouts 46 in the circumferential direction. At each of the annular-shaped side wall portions 43, each of the cutouts 46 includes an identical shape to one another. Furthermore, the positions of the cutouts 46 in the circumferential direction at one of the annular-shaped side wall portions 43 are identical to the positions of the cutouts 46 in the circumferential direction at the other of the annular-shaped side wall portions 43.

Each of the cutouts 46 includes a pair of end surfaces 48 which intersect each other at an acute angle at the end portion 47 so as to be continuous with each other smoothly in a manner that a distance between the pair of end surfaces 48 increases towards the outer circumferential side edge portion 81 serving as the start portion. Accordingly, in a plane view, each of the cutouts 46 is formed by a notch that is formed in a V-shape or a substantially V-shape where the distance between the end surfaces 48 increases towards the outer circumferential side, that is, the V-shape opens towards the outer circumferential side.

Figure 5:
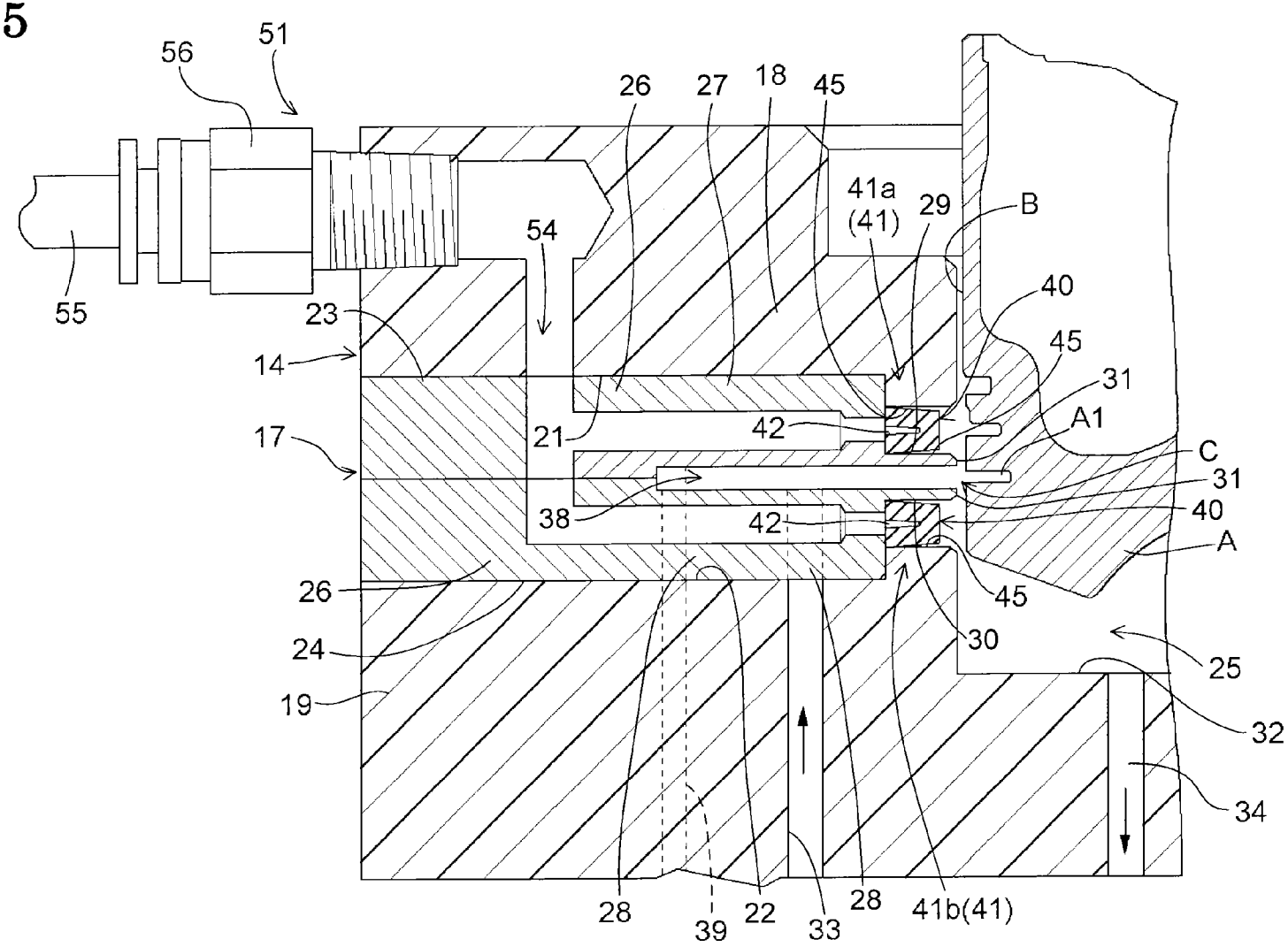
FIG. 5 is a cross-sectional view illustrating a state where annular-shaped elastic sealing members are apart from a piston outer circumferential surface according to the embodiments.
Figure 6:
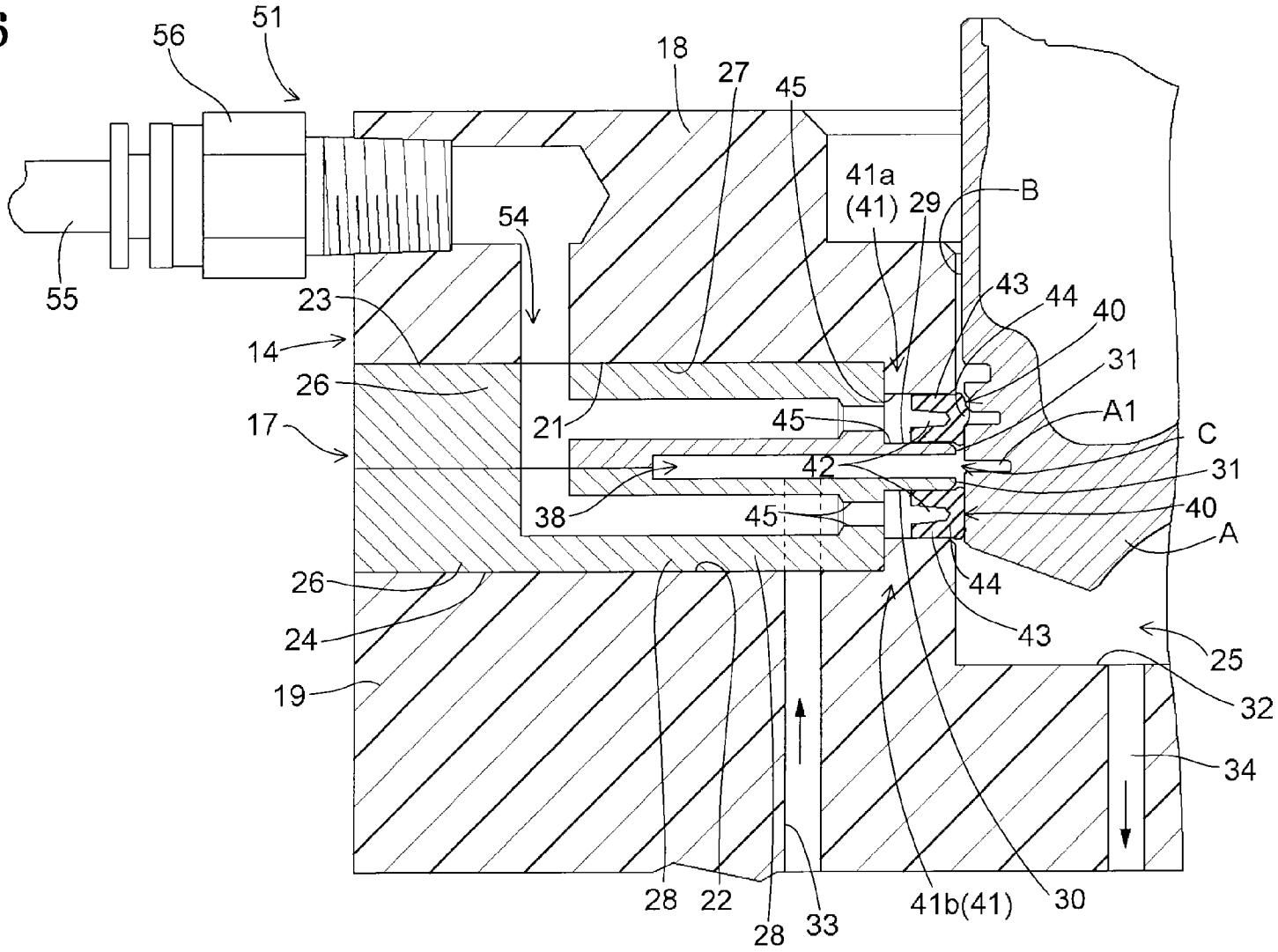
FIG. 6 a cross-sectional view illustrating a state where the annular-shaped elastic sealing members are in pressure contact with the piston outer circumferential surface.

As illustrated in FIGS. 1, 5 and 6, the partial surface treatment apparatus includes a pressure applying mechanism 51. The pressure applying mechanism 51 is configured to simultaneously supply compressed air, which serves as pressurized fluid, to the outer circumferential side of the annular-shaped elastic sealing members 40 which are fitted into the first accommodation portion 41*a* and the second accommodation portion 41*b*, respectively. Thus, the pressure applying mechanism 51 is configured to move the annular-shaped elastic sealing members 40 in the diameter reduction direction. In a case where the annular-shaped elastic sealing members 40 are moved in the diameter reduction direction, the inner circumferential side (the pressure contact surface Z of the annular-shaped end portion 44) of each of the annular-shaped elastic sealing members 40 is brought into pressure contact with the piston outer circumferential surface B along the entire circumference of the annular-shaped elastic sealing member 40. Furthermore, the pressure applying mechanism 51 is configured to release the pressure-contact of the annular-shaped elastic sealing members 40 against the piston outer circumferential surface B.

The pressure supplying mechanism 51 includes an air supply/discharge apparatus 52, a supply/discharge control portion 53, an air supply/discharge passage 54 and a pipe (tube) connector 56. The air supply/discharge apparatus 52 is configured to perform supply and discharge of the compressed air. The supply/discharge control portion 53 controls an operation of supplying/discharging the air which is conducted by the air supply/discharge apparatus 52. The air supply/discharge passage 54 is in communication with the outer circumferential sides of the respective first accommodation portion 41*a* and second accommodation portion 41*b*. The pipe connector 56 connects an air supply/discharge pipe (tube) 55 of the air supply/discharge apparatus 52 with the air supply/discharge passage 54.

The air supply/discharge passage 54 is provided at the second electrode portion 14 at three positions in a circumferential direction of the second electrode portion 14. Furthermore, each of the air supply/discharge passages 54 is connected to the air supply/discharge pipe 55 at the pipe connector 56 so that, from the three positions in the circumferential direction, the compressed air is supplied to and discharged from the first accommodation portion 41*a* and the second accommodation portion 41*b*.

Next, an operation for conducting the anodizing treatment will be given below. After the piston A is inserted into the piston insertion bore 25 and is placed on the round-shaped protruding surface portion 35, the supply/discharge control portion 53 actuates the air supply/discharge apparatus 52 to supply the compressed air to each of the first accommodation portion 41*a* and the second accommodation portion 41*b* through the corresponding air supply/discharge passages 54.

FIG. 5 illustrates a state (i.e., a fitted state) in which the annular-shaped elastic sealing members 40 are fitted into the respective first accommodation portion 41*a* and second accommodation portion 41*b* when the compressed air is not supplied by the air supply/discharge apparatus 52. FIG. 9 illustrates a shape of the annular-shaped elastic sealing member 40 in a plane view in a state where the compressed air is not supplied by the air supply/discharge apparatus 52. As illustrated in FIG. 9, each of the cutouts 46 opens towards the outer circumferential side to form the shape of a letter V. In the fitted state, the annular-shaped side wall portions 43 of each of the annular-shaped elastic sealing members 40 are closely in contact with the corresponding groove side surfaces 45.

Figure 10:
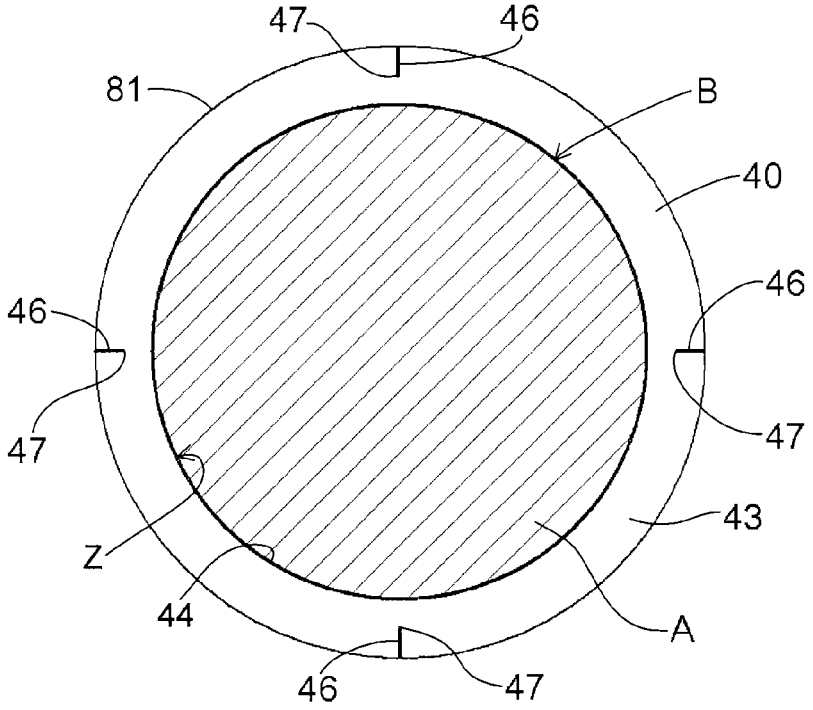
FIG. 10 a plan view illustrating the annular-shaped elastic sealing member which is in pressure contact with the piston outer circumferential surface.

FIG. 6 illustrates a state in which the compressed air is supplied by the air supply/discharge apparatus 52 to the first accommodation portion 41*a* and the second accommodation portion 41*b*, and as a result thereof, the annular-shaped elastic sealing members 40 are moved in the diameter reduction direction towards the piston outer circumferential surface B and the pressure contact surfaces Z of the annular-shaped end portions 44 are in pressure contact with the piston outer circumferential surface B. FIG. 10 illustrates a shape of the annular-shaped elastic sealing member 40 in a plane view when the pressure contact surface Z of the annular-shaped end portion 44 is in pressure contact with the piston outer circumferential surface B as a result of the supply of the compressed air by the air supply/discharge apparatus 52.

In the state where the pressure contact surface Z is in pressure contact with the piston outer circumferential surface B (i.e., a pressure contact state), the pair of end surfaces 48 forming each of the cutouts 46 are closely in contact with each other across the entire surface thereof, and the annular-shaped side wall portions 43, which are arranged at upper and lower sides, respectively, are pressed against the corresponding groove side surfaces 45 by the compressed air. As a result, a posture of each of the annular-shaped elastic sealing members 40 is stabilized and the compressed air is prevented from leaking towards the piston outer circumferential surface B.

Accordingly, because the pressure contact surfaces Z of the annular-shaped end portions 44 of the respective annular-shaped elastic sealing members 40 are in pressure contact with the piston outer circumferential surface B, the clearance C defined by the piston outer circumferential surface B and the electrode inner circumferential surfaces 31 is sealed at both sides relative to the piston ring groove A1. Then, the electrolyte solution is circulated so as to be flowed from the supply flow passage 37 into the space which is formed between the piston outer circumferential surface B and the electrode inner circumferential surfaces 31 and is sealed with each of the annular-shaped elastic sealing members 40, and so as to be discharged from the discharge flow passage 38 while the anodizing treatment is applied to the piston ring groove A1.

After the anodizing treatment to the piston ring groove A1 is completed, the supply/discharge control portion 53 actuates the air supply/discharge apparatus 52 so that the compressed air is forcibly discharged from the first accommodation portion 41*a* and the second accommodation portion 41*b* through the air supply/discharge passages 54 and the air supply/discharge pipe 55, in other words, so that the pressure contact of the annular-shaped elastic sealing members 40 with the piston outer circumferential surface B is released.

As an air pressure decreases in association with the discharge of the compressed air from the first accommodation portion 41*a* and the second accommodation portion 41*b*, each of the annular-shaped elastic sealing members 40 is deformed in a diameter expansion direction, that is, in a direction in which the diameter of the annular-shaped elastic sealing member 40 increases, to return to the original shape. Accordingly, as illustrated in FIG. 5, each of the annular-shaped elastic sealing members 40 retracts towards a back side of the corresponding accommodation portion 41, that is, deep within the corresponding accommodation portion 41, so that the annular-shaped end portions 44 do not protrude from the electrode inner circumferential surfaces 31.

Figure 11:
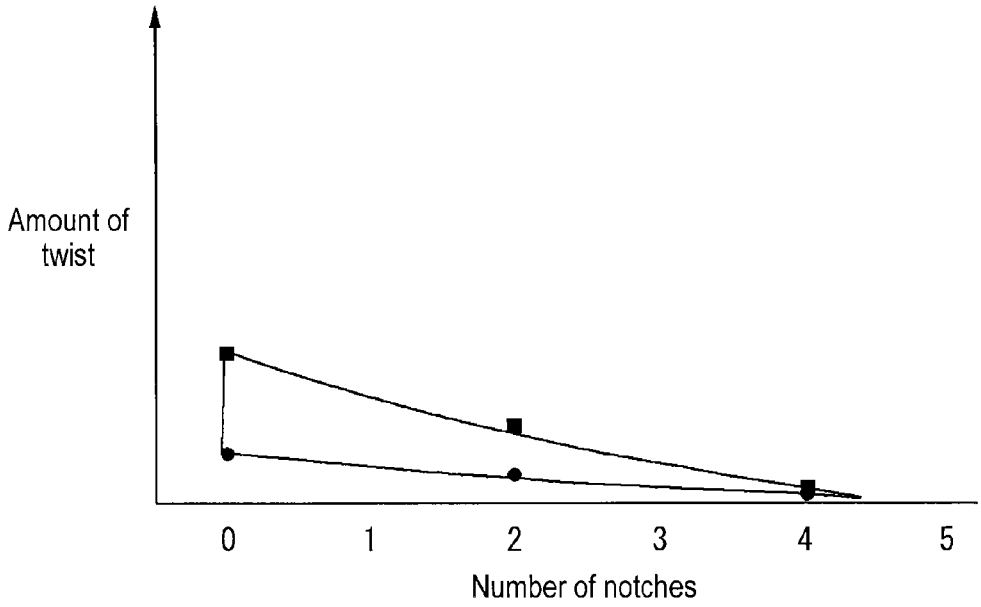
FIG. 11 is a graph representing relationship between "the number of notches" and "an amount of twist"
Figure 13:
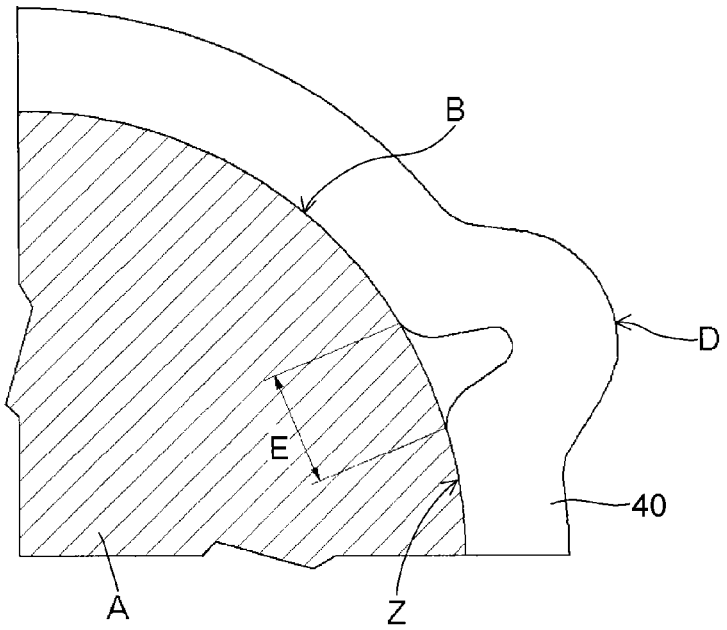
FIG. 13 is a view explaining "the amount of twist" and "the number of twists"

FIG. 11 shows a graph representing relationship between "the number of notches" and a size of a wrinkle portion D. The number of notches is the number of the cutouts 46 formed at each of the pair of annular-shaped side wall portions 43 of the annular-shaped elastic sealing member 40 so as to be arranged in the circumferential direction with the uniform interval provided between the neighboring cutouts 46. Each of the cutouts 46 is formed to include the notch configuration. The wrinkle portion D is formed in a case where the pressure contact surface Z of the annular-shaped elastic sealing member 40 is brought in pressure contact with the piston outer circumferential surface B as illustrated in FIG. 13. The size of the wrinkle portion D is defined as "an amount of twist" which corresponds to a length E of a part of the wrinkle portion D, the part which is spaced apart from the piston outer circumferential surface B (that is, a wavy part formed at the annular-shaped elastic sealing member 40) as illustrated in FIG. 13.

Figure 12:
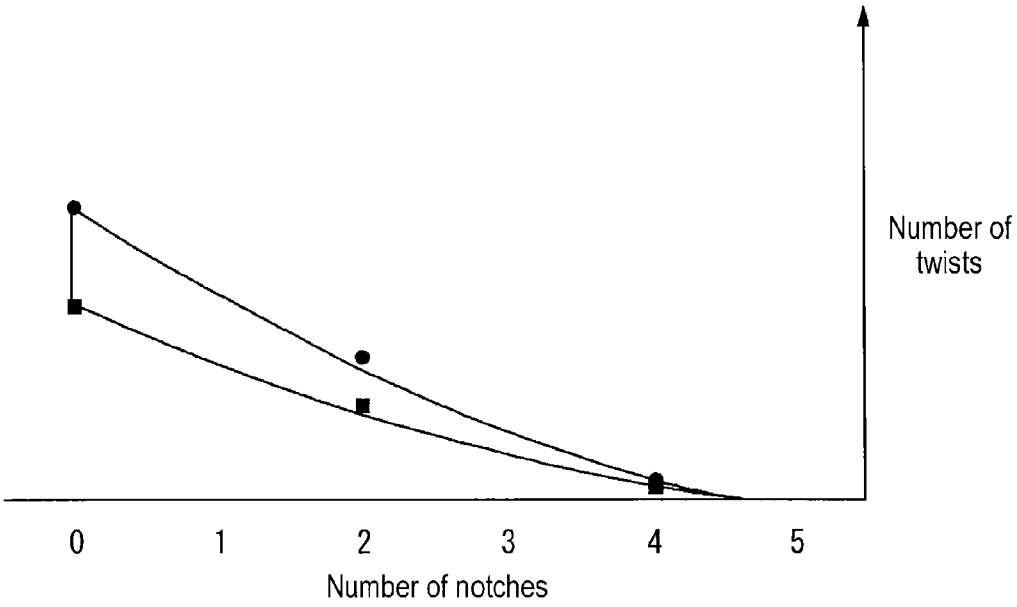
FIG. 12 a graph representing relationship between "the number of notches" and "the number of twists"

FIG. 12 illustrates a graph representing relationship between "the number of notches" and the number of the wrinkle portions D. The number of notches is the number of the cutouts 46 formed at each of the pair of annular-shaped side wall portions 43 of the annular-shaped elastic sealing member 40 so as to be arranged in the circumferential direction with the uniform interval provided between the neighboring cutouts 46. Each of the cutouts 46 is formed to include the notch configuration. The wrinkle portion D is formed in the case where the pressure contact surface Z of the annular-shaped elastic sealing member 40 is brought in pressure contact with the piston outer circumferential surface B as illustrated in FIG. 13. The number of the wrinkle portions D is defined as "the number of twists" which corresponds to the number of the parts of the wrinkle portions D, the part which is spaced apart from the piston outer circumferential surface B as illustrated in FIG. 13.

In FIGS. 11 and 12, dots appearing on each of the graphs represent relationship among a case where the cutouts 46 are not formed at the annular-shaped elastic sealing member 40, a case where the cutouts 46 are formed at two positions of the annular-shaped elastic sealing member 40 in total, and a case where the cutouts 46 are formed at four positions of the annular-shaped elastic sealing member 40 in total.

In FIGS. 11 and 12, squares appearing on each of the graphs represent relationship among a case where the cutouts 46 are not formed at another annular-shaped elastic sealing member 40 (that is, a different annular-shaped elastic sealing member 40 from the annular-shaped elastic sealing member 40 whose results are represented by the above-described dots) a case where the cutouts 46 are formed at two positions of the annular-shaped elastic sealing member 40 in total, and a case where the cutouts 46 are formed at four positions of the annular-shaped elastic sealing member 40 in total.

It may be considered that the larger a curvature of the annular-shaped elastic sealing member 40 is, the greater the number of notches may be provided. In this embodiment, each of the annular-shaped elastic sealing members 40 includes an inner diameter of approximately 77 millimeter (mm) and an outer diameter of approximately 88 millimeter (mm).

Figure 14:
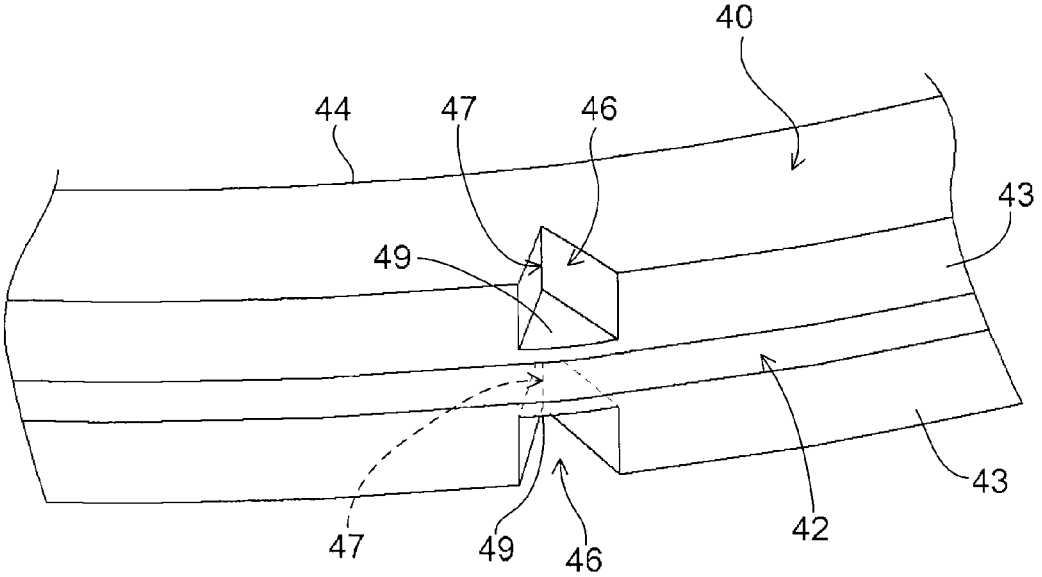
FIG. 14 is a perspective view illustrating an annular-shaped elastic sealing member of the second embodiment.

A second embodiment disclosed here will be described hereunder with reference to the drawing. FIG. 14 illustrates another embodiment of the cutout 46 formed at each of the annular-shaped side wall portions 43 of the annular-shaped elastic sealing members 40. In this embodiment, the pair of end surfaces 48, which constitute each of the cutouts 46 formed in the notch configuration, are integrally connected to each other at a thin portion 49. The thin portion 49 includes a fan shape formed along the circumferential direction of the annular-shaped elastic sealing member 40 and is provided at a side at which the pair of annular-shaped side wall portions 43 face each other across the recessed portion 42.

According to this embodiment, the number and/or the size of the wrinkle portions, which are generated at the annular-shaped elastic sealing members 40, are restricted from increasing while the compressed air is reliably prevented from leaking from the recessed portions 42 to the cutouts 46 and the electrolyte solution is reliably prevented from leaking from the cutouts 46 to the recessed portions 42. Other structures and configurations in the second embodiment are similar to those of the first embodiment.

Other embodiments will be described hereunder. 1. According to the partial surface treatment apparatus disclosed here, only one of the pair of annular-shaped side wall portions may be provided with "the cutout". 2. According to the partial surface treatment apparatus disclosed here, the number and/or the shape of "the cutout" formed at one of the pair of annular-shaped side wall portions may differ from the number and/or the shape of "the cutout" formed at the other of the pair of annular-shaped side wall portions. 3. According to the partial surface treatment apparatus disclosed here, "the cutout" formed at one of the pair of annular-shaped side wall portions and "the cutout" formed at the other of the pair of annular-shaped side wall portions may be arranged to be dislocated or offset from each other in the circumferential direction. 4. The partial surface treatment apparatus disclosed here may include "the cutout" which is formed in such a manner that the end surfaces formed by the cutout are closely in contact with each other. 5. According to the partial surface treatment apparatus disclosed here, the end portion of "the cutout", whose start portion corresponds to the outer circumferential side edge portion of the annular-shaped side wall portion, may be provided within a region of the annular-shaped end portion. In this case, the end portion of "the cutout" formed at one of the pair of annular-shaped side wall portions and the end portion of "the cutout" formed at the other of the pair of annular-shaped side wall portions may be connected to each other serially or continuously in the axial direction. 6. The partial surface treatment apparatus disclosed here may include a pressure applying mechanism configured to supply pressurized liquid such as operating fluid which serves as the pressurized fluid. 7. The partial surface treatment apparatus disclosed here is applicable to various types of partial surface treatment apparatuses, for example, treatment equipment for conducting a surface treatment such as an electroplating treatment.

According to the aforementioned embodiment, the partial surface treatment apparatus includes the first electrode member 15 electrically connected to the piston A made of metal, the piston A including the piston outer circumferential surface B and the piston ring groove A1 formed at the piston outer circumferential surface B, the second electrode member 17 including the electrode inner circumferential surface 31 facing the piston outer circumferential surface B and the piston ring groove A1, the electrode inner circumferential surface 31 being spaced apart from the piston outer circumferential surface B and the piston ring groove A1 along the entire circumference of the electrode inner circumferential surface 31, the pair of annular-shaped elastic sealing members 40 each of which is nonconductive, the annular-shaped elastic sealing members 40 being configured to seal, at both sides relative to the piston ring groove A1, the clearance C formed between the piston outer circumferential surface B and the electrode inner circumferential surface 31, the accommodation portion 41 accommodating each of the annular-shaped elastic sealing members 40 in such a manner that the annular-shaped elastic sealing member 40 is spaced apart from the piston outer circumferential surface B and that the annular-shaped elastic sealing member 40 is movable in the diameter reduction direction, the accommodation portion 41 including the groove side surfaces 45 arranged to face each other, the pressure applying mechanism 51 configured to supply the compressed air to the outer circumferential side of the annular-shaped elastic sealing members 40 fitted into the accommodation portions 41 in order to move the annular-shaped elastic sealing members 40 in the diameter reduction direction, the inner circumferential side of each of the annular-shaped elastic sealing members 40 being in pressure contact with the piston outer circumferential surface B in a case where the annular-shaped elastic sealing members 40 are moved in the diameter reduction direction, the pressure applying mechanism 51 configured to release the pressure contact between the annular-shaped elastic sealing members 40 and the piston outer circumferential surface B, the supply flow passage 37 through which the electrolyte solution is supplied to the space formed between the piston outer circumferential surface B and the electrode inner circumferential surface 31, the space being sealed with the pair of annular-shaped elastic sealing members 40, each of the annular-shaped elastic sealing members 40 being formed in the shape including the pair of annular-shaped side wall portions 43 and the annular-shaped end portion 44, the pair of annular-shaped side wall portions 43 being configured to be in slidably contact with the corresponding groove side surfaces 45 of the accommodation portion 41 while the pair of annular-shaped side wall portions 43 being apart from each other in the groove width direction, the annular-shaped end portion 44 connecting the inner circumferential portions of the respective annular-shaped side wall portions 43 to each other serially, and the cutout 46 being formed at each of the annular-shaped elastic sealing members 40 to be extended from the outer circumferential side edge portion 81 of the annular-shaped elastic sealing member 40 towards the inner circumferential side of the annular-shaped elastic sealing member 40, the cutout 46 being provided at at least one position which is along the circumferential direction of the annular-shaped elastic sealing member 40.

According to the above described configuration, the cutout 46 is formed at at least one position which is along the circumferential direction of the annular-shaped elastic sealing member 40 to be extended from the outer circumferential side edge portion 81 of the annular-shaped elastic sealing member 40 towards the inner circumferential side of the annular-shaped elastic sealing member 40. Accordingly, when the compressed air is supplied to the outer circumferential side of the annular-shaped elastic sealing member 40 in order to move the annular-shaped elastic sealing member 40 in the diameter reduction direction in which the inner circumferential side of the annular-shaped elastic sealing member 40 is brought into pressure contact with the piston outer circumferential surface B, the portions of the annular-shaped elastic sealing member 40 which face each other across the cutout 46 are deformed relative to each other so that the wrinkle is restricted from being formed at the annular-shaped elastic sealing member 40. Accordingly, the wrinkle is not likely to be formed to the annular-shaped elastic sealing member 40 in a case where the clearance C formed between the piston outer circumferential surface B of the piston A and the electrode inner circumferential surface 31 of the second electrode member 17 is sealed.

Consequently, according to the partial surface treatment apparatus of the aforementioned embodiments, the electrolyte solution does not tend to leak out even in a case where the moving speed of the annular-shaped elastic sealing member 40 in the diameter reduction direction is increased. Thus, efficiency in performing the surface treatment to the piston ring groove A1 is easily enhanced and the electrolyte solution is prevented from being mixed with the compressed air. As a result, inconvenience including damage to the pressure applying mechanism 51 is not likely to occur.

According to the aforementioned embodiment, the cutout 46 includes the start portion and the end portion 47, and the start portion corresponds to the outer circumferential side edge portion 81 of the annular-shaped elastic sealing member 40 and the end portion 47 is provided within the region of the annular-shaped side wall portions 43.

According to the above described configuration, the cutout 46 is formed in a manner that the cutout 46 does not come into or does not enter the annular-shaped end portion 44. Consequently, the annular-shaped end portion 44 is prevented from being excessively deformed in association with the decrease of the diameter of the annular-shaped elastic sealing member 40. As a result, a sealing performance of the annular-shaped elastic sealing member 40 is maintained easily for a long period of time. Furthermore, when compared to a case where the end portion 47 of the cutout 46 is provided at the annular-shaped end portion 44, strength of the annular-shaped end portion 44 is maintained more easily for a longer period of time.

According to the aforementioned embodiment, the cutout 46 includes the start portion corresponding to the outer circumferential side edge portion 81 of the annular-shaped elastic sealing member 40 and the end portion 47, and the cutout 46 includes the pair of end surfaces 48 which intersect each other at the acute angle at the end portion 47 and are continuous with each other smoothly in a manner that the distance between the pair of end surfaces 48 increases towards the start portion.

According to the above described configuration, the end surfaces 48, which face or oppose each other with the cutout 46 interposed therebetween, are prevented from coming into a close contact with each other when the annular-shaped elastic sealing member 40 moves in the diameter reduction direction, and thus the occurrence of the wrinkle is avoided. Furthermore, because the opposing end surfaces 48 are brought into close contact with each other gradually from a side of the end portion 47, the electrolyte solution is prevented from leaking out from the cutout 46.

According to the aforementioned embodiment, the cutout 46 is formed at each of the pair of annular-shaped side wall portions 43.

According to the above described configuration, in association with the movement of the annular-shaped elastic sealing member 40 in the diameter reduction direction, a posture of the annular-shaped end portion 44 in a seal width direction is maintained constant more easily compared to a case where the cutout 46 is formed at only one of the pair of annular-shaped side wall portions 43. Accordingly, a press-contact force relative to the outer circumferential surface of the annular-shaped end portions 44 is distributed in the seal width direction, and thus the clearance C is easily sealed in a stabled manner.

According to the aforementioned embodiment, the partial surface treatment apparatus includes the first electrode member 15 electrically connected to the piston A made of metal, the piston A including the piston outer circumferential surface B and the piston ring groove A1 formed at the piston outer circumferential surface B, the second electrode member 17 including the electrode inner circumferential surface 31 facing the piston outer circumferential surface B and the piston ring groove A1, the electrode inner circumferential surface 31 being spaced apart from the piston outer circumferential surface B and the piston ring groove A1 along the entire circumference of the electrode inner circumferential surface 31, the pair of annular-shaped elastic sealing members 40 each of which is nonconductive, the annular-shaped elastic sealing members 40 being configured to seal, at both sides relative to the piston ring groove A1, the clearance C formed between the piston outer circumferential surface B and the electrode inner circumferential surface 31, the accommodation portion 41 accommodating each of the annular-shaped elastic sealing members 40 in such a manner that the annular-shaped elastic sealing member 40 is spaced apart from the piston outer circumferential surface B and that the annular-shaped elastic sealing member 40 is movable in the diameter reduction direction, the accommodation portion 41 including the groove side surfaces 45 arranged to face each other, the pressure applying mechanism 51 configured to supply the compressed air to the outer circumferential side of the annular-shaped elastic sealing members 40 fitted into the accommodation portions 41 in order to move the annular-shaped elastic sealing members 40 in the diameter reduction direction, the inner circumferential side of each of the annular-shaped elastic sealing members 40 being in pressure contact with the piston outer circumferential surface B in a case where the annular-shaped elastic sealing members 40 are moved in the diameter reduction direction, the pressure applying mechanism 51 configured to release the pressure contact between the annular-shaped elastic sealing members 40 and the piston outer circumferential surface B, the supply flow passage 37 through which the electrolyte solution is supplied to the space formed between the piston outer circumferential surface B and the electrode inner circumferential surface 31, the space being sealed with the pair of annular-shaped elastic sealing members 40, each of the annular-shaped elastic sealing members 40 including the pair of annular-shaped side wall portions 43, the annular-shaped end portion 44 and the plural cutouts 46, the pair of annular-shaped side wall portions 43 being configured to be in slidably contact with the corresponding groove side surfaces of the accommodation portion 41, the pair of annular-shaped side wall portions 43 being apart from each other in the groove width direction, the annular-shaped end portion 44 connecting the inner circumferential portions of the respective annular-shaped side wall portions 43 to each other serially, the plurality of cutouts 46 being formed along the circumferential direction of the annular-shaped elastic sealing member 40 while the uniform space is provided therebetween, each of the cutouts 46 being extended from the outer circumferential edge of the annular-shaped elastic sealing member 40 towards the radially inner side of the annular-shaped elastic sealing member 40.

According to the above described configuration, the plural cutouts 46 are formed along the circumferential direction of the annular-shaped elastic sealing member 40 in a manner that the uniform space is provided between the neighboring cutouts 46 in the circumferential direction. Accordingly, when the compressed air is supplied to the outer circumferential side of the annular-shaped elastic sealing member 40 in order to move the annular-shaped elastic sealing member 40 in the diameter reduction direction in which the inner circumferential side of the annular-shaped elastic sealing member 40 is brought into pressure contact with the piston outer circumferential surface B, the portions of the annular-shaped elastic sealing member 40 which face each other across the cutout 46 are deformed relative to each other so that the wrinkle is restricted from being formed at the annular-shaped elastic sealing member 40. Accordingly, the wrinkle is not likely to be formed to the annular-shaped elastic sealing member 40 in a case where the clearance C formed between the piston outer circumferential surface B of the piston A and the electrode inner circumferential surface 31 of the second electrode member 17 is sealed.

Consequently, according to the partial surface treatment apparatus of the embodiments, the electrolyte solution does not tend to leak out even in a case where the moving speed of the annular-shaped elastic sealing member 40 in the diameter reduction direction is increased. Thus, the efficiency in performing the surface treatment to the piston ring groove A1 is easily enhanced and the electrolyte solution is prevented from being mixed with the compressed air. As a result, the inconvenience including the damage to the pressure applying mechanism 51 is not likely to occur.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A partial surface treatment apparatus, comprising:

a first electrode member electrically connected to a treatment object made of metal, the treatment object including an outer circumferential surface and a circumferential groove formed at the outer circumferential surface;

a second electrode member including an inner circumferential surface facing the outer circumferential surface and the circumferential groove, the inner circumferential surface being spaced apart from the outer circumferential surface and the circumferential groove along an entire circumference of the inner circumferential surface;

a pair of annular-shaped elastic sealing members, each of which is nonconductive, the annular-shaped elastic sealing members being configured to seal, at both sides relative to the circumferential groove, a clearance formed between the outer circumferential surface and the inner circumferential surface;

an accommodation portion accommodating each of the annular-shaped elastic sealing members in such a manner that the annular-shaped elastic sealing member is spaced apart from the outer circumferential surface and that the annular-shaped elastic sealing member is movable in a diameter reduction direction, the accommodation portion including groove side surfaces arranged to face each other;

a pressure applying mechanism configured to supply a pressurized fluid to an outer circumferential side of the annular-shaped elastic sealing members fitted into the accommodation portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact between the annular-shaped elastic sealing members and the outer circumferential surface;

a supply flow passage through which electrolyte solution is supplied to a space formed between the outer circumferential surface and the inner circumferential surface, the space being sealed with the pair of annular-shaped elastic sealing members;

each of the annular-shaped elastic sealing members being formed in a shape including a pair of annular-shaped side wall portions and an annular-shaped end portion, the pair of annular-shaped side wall portions being configured to be in slidable contact with the corresponding groove side surfaces of the accommodation portion while the pair of annular-shaped side wall portions being apart from each other in a groove width direction, the annular-shaped end portion connecting inner circumferential portions of the respective annular-shaped side wall portions to each other serially; and a cutout being formed at each of the annular-shaped elastic sealing members to be extended from an outer circumferential side edge portion of the annular-shaped elastic sealing member towards the inner circumferential side of the annular-shaped elastic sealing member, the cutout being provided at at least one position which is along a circumferential direction of the annular-shaped elastic sealing member, wherein the cutout extends completely through at least one of the annular-shaped side wall portions in an axial direction.

2. The partial surface treatment apparatus according to claim 1, wherein the cutout includes a start portion and an end portion, and the start portion corresponds to the outer circumferential side edge portion of the annular-shaped elastic sealing member and the end portion is provided within a region of the annular-shaped side wall portions.

3. The partial surface treatment apparatus according to claim 1, wherein the cutout includes a start portion corresponding to the outer circumferential side edge portion of the annular-shaped elastic sealing member and an end portion, and the cutout includes a pair of end surfaces which intersect each other at an acute angle at the end portion and are continuous with each other smoothly in a manner that a distance between the pair of end surfaces increases towards the start portion.

4. The partial surface treatment apparatus according to claim 1, wherein the cutout is formed at each of the pair of annular-shaped side wall portions.

5. A partial surface treatment apparatus, comprising:

a first electrode member electrically connected to a treatment object made of metal, the treatment object including an outer circumferential surface and a circumferential groove formed at the outer circumferential surface;

a second electrode member including an inner circumferential surface facing the outer circumferential surface and the circumferential groove, the inner circumferential surface being spaced apart from the outer circumferential surface and the circumferential groove along an entire circumference of the inner circumferential surface;

a pair of annular-shaped elastic sealing members, each of which is nonconductive, the annular-shaped elastic sealing members being configured to seal, at both sides relative to the circumferential groove, a clearance formed between the outer circumferential surface and the inner circumferential surface;

an accommodation portion accommodating each of the annular-shaped elastic sealing members in such a manner that the annular-shaped elastic sealing member is spaced apart from the outer circumferential surface and that the annular-shaped elastic sealing member is movable in a diameter reduction direction, the accommodation portion including groove side surfaces arranged to face each other;

a pressure applying mechanism configured to supply a pressurized fluid to an outer circumferential side of the annular-shaped elastic sealing members fitted into the accommodation portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact between the annular-shaped elastic sealing members and the outer circumferential surface;

a supply flow passage through which electrolyte solution is supplied to a space formed between the outer circumferential surface and the inner circumferential surface, the space being sealed with the pair of annular-shaped elastic sealing members; and each of the annular-shaped elastic sealing members including a pair of annular-shaped side wall portions, an annular-shaped end portion and a plurality of cutouts, the pair of annular-shaped side wall portions being configured to be in slidable contact with the corresponding groove side surfaces of the accommodation portion, the pair of annular-shaped side wall portions being apart from each other in a groove width direction, the annular-shaped end portion connecting inner circumferential portions of the respective annular-shaped side wall portions to each other serially, the plurality of cutouts being formed along a circumferential direction of the annular-shaped elastic sealing member while a uniform space is provided therebetween, each of the cutouts being extended from an outer circumferential edge of the annular-shaped elastic sealing member towards a radially inner side of the annular-shaped elastic sealing member, wherein the cutout extends completely through at least one of the annular-shaped side wall portions in an axial direction.

6. The partial surface treatment apparatus according to claim 5, wherein each of the cutouts includes a start portion and an end portion, and the start portion corresponds to the outer circumferential side edge portion of the annular-shaped elastic sealing member and the end portion is provided within a region of the annular-shaped side wall portions.

7. The partial surface treatment apparatus according to claim 5, wherein each of the cutouts includes a start portion corresponding to the outer circumferential side edge portion of the annular-shaped elastic sealing member and an end portion, and each of the cutouts includes a pair of end surfaces which intersect each other at an acute angle at the end portion and are continuous with each other smoothly in a manner that a distance between the pair of end surfaces increases towards the start portion.

8. The partial surface treatment apparatus according to claim 5, wherein the cutouts are formed at each of the pair of annular-shaped side wall portions.

9. The partial surface treatment apparatus according to claim 1, wherein a cross-section of the cutout along a plane perpendicular to the axial direction has a circular sector shape.

10. The partial surface treatment apparatus according to claim 5, wherein a cross-section of the cutout along a plane perpendicular to the axial direction has a circular sector shape.

11. A partial surface treatment apparatus, comprising:

a first electrode member electrically connected to a treatment object made of metal, the treatment object including an outer circumferential surface and a circumferential groove formed at the outer circumferential surface;

a second electrode member including an inner circumferential surface facing the outer circumferential surface and the circumferential groove, the inner circumferential surface being spaced apart from the outer circumferential surface and the circumferential groove along an entire circumference of the inner circumferential surface;

a pair of annular-shaped elastic sealing members, each of which is nonconductive, the annular-shaped elastic sealing members being configured to seal, at both sides relative to the circumferential groove, a clearance formed between the outer circumferential surface and the inner circumferential surface;

an accommodation portion accommodating each of the annular-shaped elastic sealing members in such a manner that the annular-shaped elastic sealing member is spaced apart from the outer circumferential surface and that the annular-shaped elastic sealing member is movable in a diameter reduction direction, the accommodation portion including groove side surfaces arranged to face each other;

a pressure applying mechanism configured to supply a pressurized fluid to an outer circumferential side of the annular-shaped elastic sealing members fitted into the accommodation portions in order to move the annular-shaped elastic sealing members in the diameter reduction direction, an inner circumferential side of each of the annular-shaped elastic sealing members being in pressure contact with the outer circumferential surface in a case where the annular-shaped elastic sealing members are moved in the diameter reduction direction, the pressure applying mechanism configured to release the pressure contact between the annular-shaped elastic sealing members and the outer circumferential surface;

a supply flow passage through which electrolyte solution is supplied to a space formed between the outer circumferential surface and the inner circumferential surface, the space being sealed with the pair of annular-shaped elastic sealing members;

each of the annular-shaped elastic sealing members being formed in a shape including a pair of annular-shaped side wall portions and an annular-shaped end portion, the pair of annular-shaped side wall portions being configured to be in slidable contact with the corresponding groove side surfaces of the accommodation portion while the pair of annular-shaped side wall portions being apart from each other in a groove width direction, the annular-shaped end portion connecting inner circumferential portions of the respective annular-shaped side wall portions to each other serially; and a cutout being formed at each of the annular-shaped elastic sealing members to be extended from an outer circumferential side edge portion of the annular-shaped elastic sealing member towards the inner circumferential side of the annular-shaped elastic sealing member, the cutout being provided at at least one position which is along a circumferential direction of the annular-shaped elastic sealing member, wherein the cutout extends completely through at least one of the annular-shaped side wall portions in an axial direction, and wherein a cross-section of the cutout along a plane perpendicular to the axial direction has a circular sector shape.

* * * * *